US007293993B2

(12) United States Patent
Fedorov et al.

(10) Patent No.: US 7,293,993 B2
(45) Date of Patent: Nov. 13, 2007

(54) BOARD ASSEMBLY

(75) Inventors: Gennadi I. Fedorov, Andover, NJ (US); Frederick B. Hadtke, New Providence, NJ (US); Kiat-Cheong Toh, Forest Hills, NY (US)

(73) Assignee: Rose Art Industries, Inc., Livingston, NJ (US)

( * ) Notice: Subject to any disclaimer, the term of this patent is extended or adjusted under 35 U.S.C. 154(b) by 436 days.

(21) Appl. No.: 10/749,953

(22) Filed: Dec. 31, 2003
(Under 37 CFR 1.47)

(65) Prior Publication Data

US 2005/0166541 A1 Aug. 4, 2005

(51) Int. Cl.
*B43L 1/00* (2006.01)

(52) U.S. Cl. ..... 434/408

(58) Field of Classification Search ..... 434/408, 434/413, 414, 415, 416, 422, 423, 425, 428, 434/429; D19/52; 40/781, 606.1
See application file for complete search history.

(56) References Cited

U.S. PATENT DOCUMENTS

| | | | | |
|---|---|---|---|---|
| 34,664 | A | | 3/1862 | Shaw |
| D6,684 | S | | 5/1873 | Coffin |
| 373,235 | A | | 11/1887 | Isbell |
| D27,461 | S | | 8/1897 | McConnellogue |
| 723,340 | A | | 3/1903 | Tompkins |
| D174,015 | S | | 2/1955 | Bosma |
| D250,652 | S | | 12/1978 | Anderson |
| 4,133,123 | A | | 1/1979 | Anderson |
| D267,608 | S | | 1/1983 | Brescia et al. |
| D268,118 | S | | 3/1983 | Herr et al. |
| D270,074 | S | | 8/1983 | Read |
| D274,589 | S | | 7/1984 | Christensen et al. |
| D297,149 | S | | 8/1988 | Johnston |
| D302,986 | S | | 8/1989 | Takai et al. |
| D327,710 | S | | 7/1992 | Hofman |
| D330,042 | S | | 10/1992 | Yamaguchi et al. |
| D343,865 | S | | 2/1994 | Pohl |
| 5,295,342 | A | | 3/1994 | Roche et al. |
| 5,307,574 | A | * | 5/1994 | Huff, Jr. ..... 40/781 |
| 5,441,418 | A | | 8/1995 | Brown et al. |
| D363,313 | S | | 10/1995 | Willems |
| 5,527,568 | A | | 6/1996 | Boone et al. |
| D371,806 | S | | 7/1996 | Boone et al. |
| D377,948 | S | | 2/1997 | Pruhs |
| 5,658,635 | A | | 8/1997 | Davis et al. |
| D388,459 | S | | 12/1997 | Jack |
| D390,263 | S | | 2/1998 | Jack |
| 5,743,414 | A | | 4/1998 | Baudino |
| D402,696 | S | * | 12/1998 | Rosen ..... D19/52 |

(Continued)

OTHER PUBLICATIONS

U.S. Appl. No. 29/196,620, Fedorov.

*Primary Examiner*—Kurt Fernstrom
(74) *Attorney, Agent, or Firm*—McCarter & English, LLP

(57) ABSTRACT

A board assembly includes a panel and a frame. The frame has a generally annular shape and includes first and second sections. The panel is retained between the first and second sections. The frame also includes a snap-fit device positioned on at least one of the first and second sections for attaching the second section to the first section, thereby facilitating the assembly of the panel with the frame. The frame also includes a plurality of storage pockets formed therewithin for receiving a writing instrument in different orientations.

11 Claims, 10 Drawing Sheets

U.S. PATENT DOCUMENTS

D402,697 S 12/1998 Rosen
D410,636 S 6/1999 Arthur et al.
5,987,794 A * 11/1999 Lavi et al. ..... 40/611.04
5,987,825 A 11/1999 Rosen
D417,963 S 12/1999 McGrane
6,166,326 A * 12/2000 Nakajima ..... 174/36
6,240,665 B1 * 6/2001 Brown et al. ..... 40/570
6,647,652 B1 * 11/2003 Seiber et al. ..... 40/606.1
6,651,370 B1 * 11/2003 Sud ..... 40/743
6,694,656 B2 * 2/2004 Flodin et al. ..... 40/781
D496,068 S 9/2004 Mandel
D506,074 S 6/2005 Chen et al.
D507,302 S 7/2005 Chen et al.
2005/0066560 A1 * 3/2005 Ternovits et al. ..... 40/606.19

* cited by examiner

BOARD ASSEMBLY

FIELD OF THE INVENTION

The present invention relates to a board assembly, and, more particularly, to a board assembly having a frame and a panel mounted thereto.

BACKGROUND OF THE INVENTION

Conventional dry-erase boards (see, e.g., U.S. Pat. Nos. 5,987,825, Des. 402,696 and Des. 402,697) have erasable surfaces for writing notes, messages and the like. These boards are adapted to be hung easily from many different types of supporting surfaces, such as a refrigerator door, a wall, etc., and are in wide use at homes and offices.

A conventional dry-erase board includes a frame and a substantially rigid panel having a dry-erase writing surface. More particularly, the panel is typically glued to the frame. Due to the time required for applying and curing the glue, it takes a relatively large amount of time to construct the board, thereby rendering its assembly inefficient and/or costly. Other types of board assemblies, such as picture/photograph frames, poster boards, push-pin boards, etc., utilize comparable mechanisms (e.g., glue, nails, staples and screws) for mounting panels to associated frames and therefore suffer from similar problems. As a result, there is a need for an improved board assembly adapted for quick and easy construction.

In addition to the frame and panel, the conventional dry-erase board is provided with a holder for storing a writing instrument, such as a dry-erase marker. Typically, the holder is in the form of a clip mounted to the frame. Other types of holding mechanisms have also been developed. For instance, U.S. Pat. No. Des 402,696 discloses a dry-erase board frame having a plurality of slots for receiving and retaining a writing instrument therein. While these holding mechanisms are relatively cost-effective, there is a need for an improved holding mechanism for enhancing the functionality and/or appearance of the dry-erase board.

SUMMARY OF THE INVENTION

The present invention overcomes the disadvantages and shortcomings of the prior art discussed above by providing a new and improved board assembly including a panel and a frame. The frame has a generally annular shape and includes first and second sections. The panel is retained between the first and second sections. The frame also includes a snap-fit device positioned on at least one of the first and second sections for attaching the second section to the first section, thereby facilitating the assembly of the panel with the frame. More particularly, the snap-fit device includes at least one first coupling member, which is provided on the first section of the frame, and at least one second coupling member, which is provided on the second section of the frame. The first coupling member engages the second coupling member so as to secure the second section to the first section.

The present invention also provides a panel assembly including a panel and a frame which is coupled to the panel and which has at least one side including at least one exterior wall. The side includes at least one channel extending through the exterior wall in a direction substantially collinear with the side and defining at least one storage pocket which is sized and shaped so as to receive and hold a writing instrument. More particularly, the side includes first and second channels extending through the exterior wall. The first channel defines a first storage pocket for receiving a writing instrument in a first orientation, while the second channel defines a second storage pocket for receiving a writing instrument in a second orientation which is different from the first orientation.

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF THE EXEMPLARY EMBODIMENTS

Figure 1:
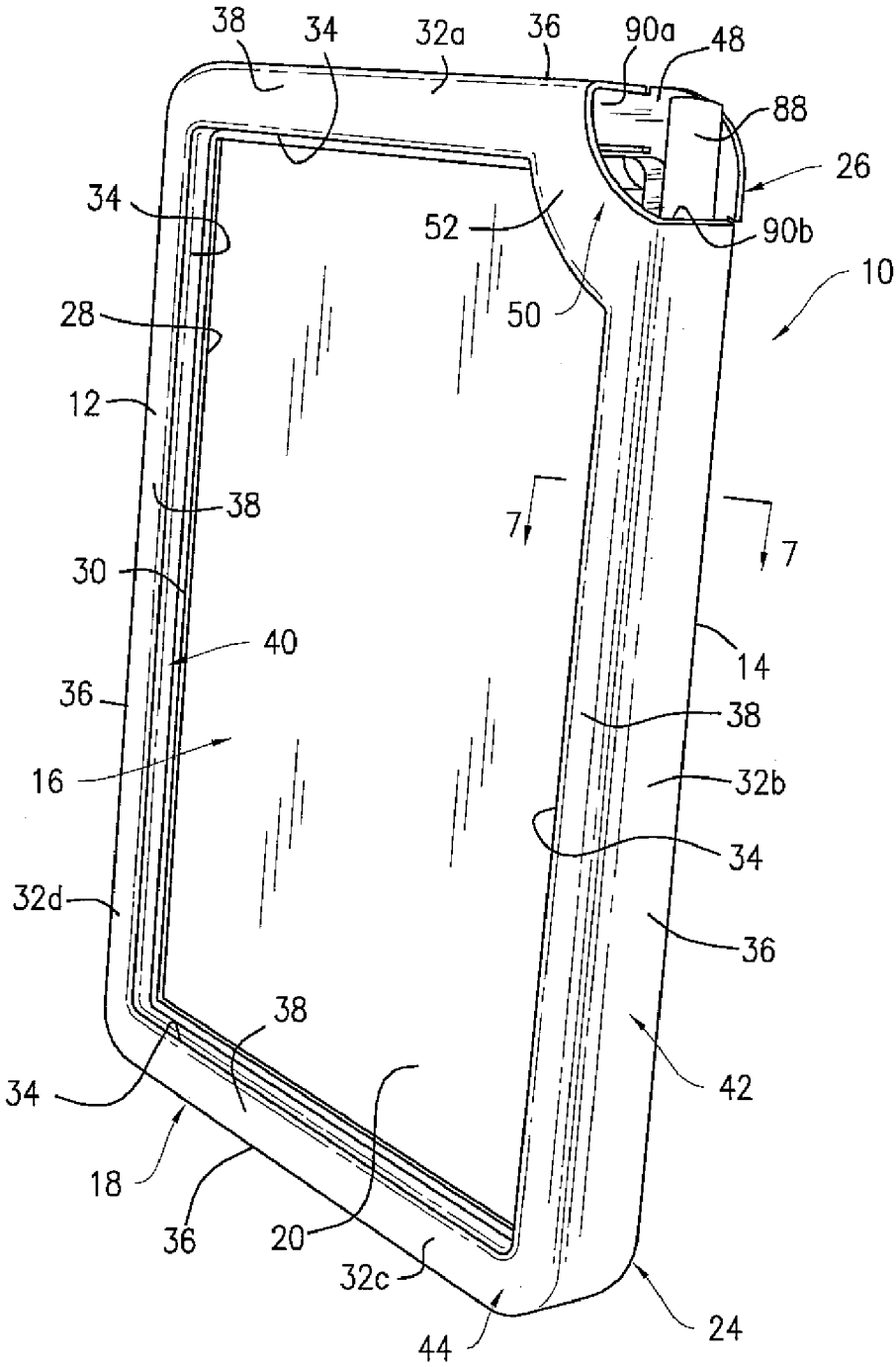
FIG. 1 is a perspective view of a dry-erase board constructed in accordance with a first embodiment of the present invention.
Figure 2:
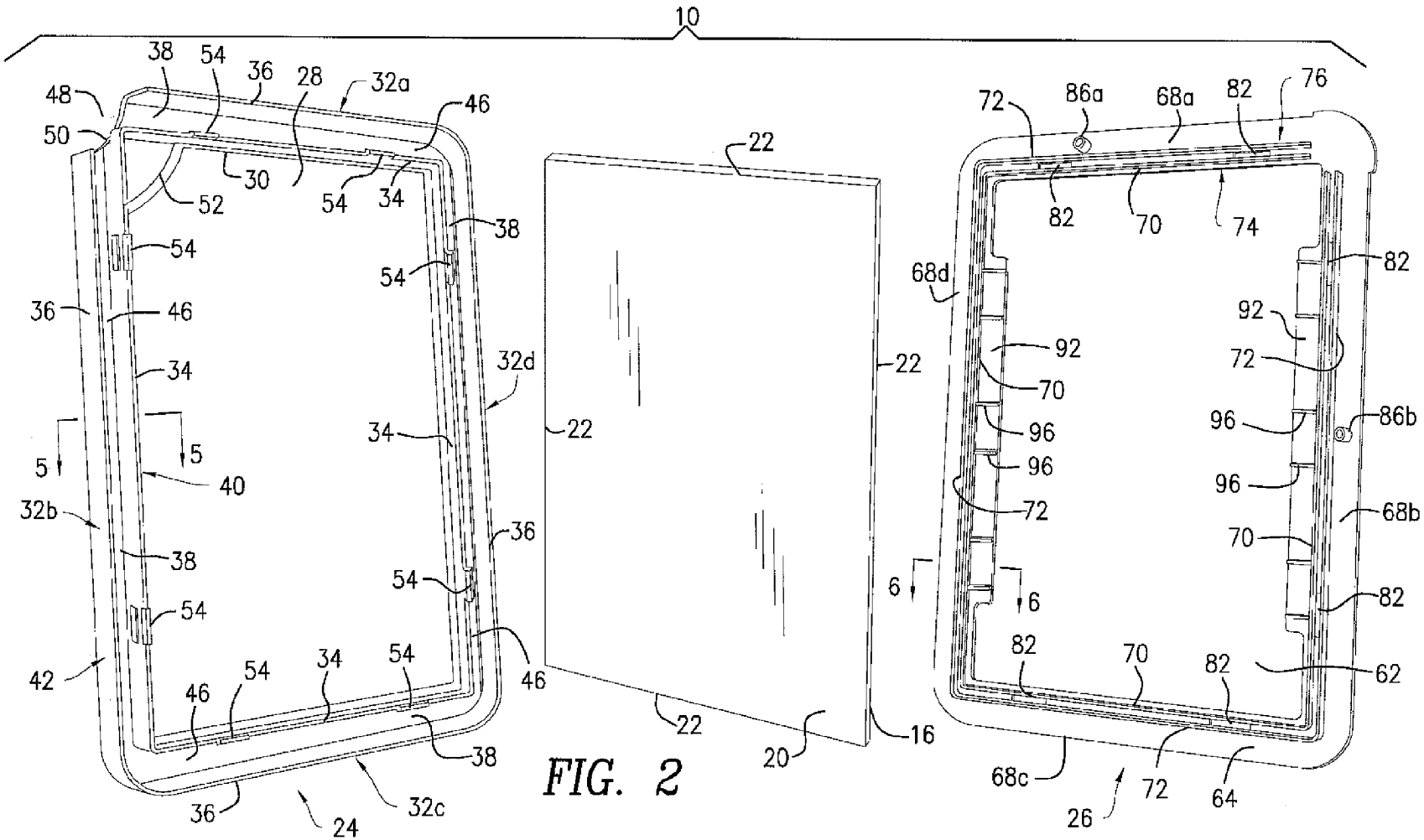
FIG. 2 is an exploded perspective view of the board shown in FIG. 1.

With reference to FIGS. 1 and 2, there is shown a dry-erase board 10 constructed in accordance with a first embodiment of the present invention. The board 10, which has a front side 12 and a rear side 14, includes a writing panel 16 and a frame 18. The panel 16 has a construction which is basically identical or similar to a panel utilized in a conventional dry-erase board, white board or marker board. For instance, the panel 16 includes a front writing surface 20 and edges 22. The front writing surface 20 is constructed in a conventional manner such that it can be written on with a conventional writing instrument (e.g., a dry-erase marker).

Still referring to FIGS. 1 and 2, the frame 18 has an annular, generally rectangular shape and is defined by a pair of frame sections (i.e., a front frame section 24 and a rear frame section 26) which are snap-fitted to each other for capturing the panel 16 therebetween. As used herein, the term "annular" shall not be limited to denote a ring-like structure having a circular shape, but shall include all geometric and non-geometric shapes, such as oval, triangular, rectangular and other polygonal shapes.

Figure 7:
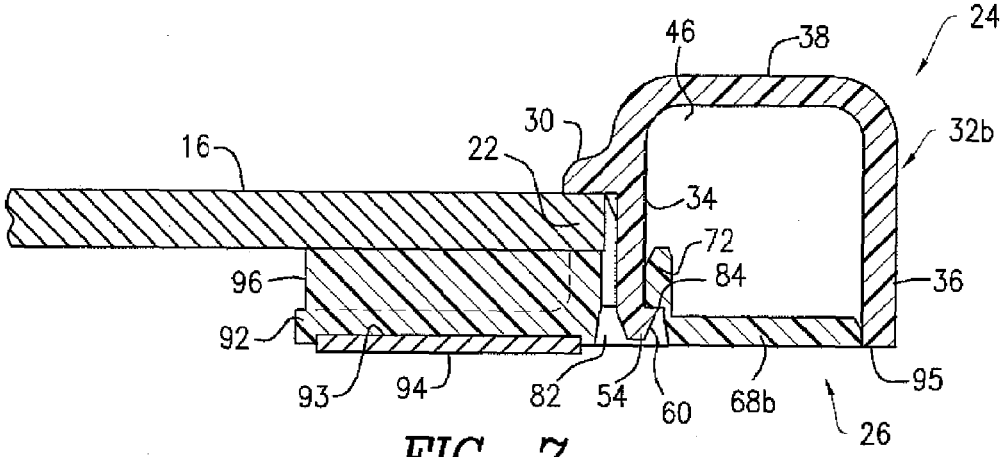
FIG. 7 is a cross-sectional view, taken along section line 7-7 and looking in the direction of the arrows, of the board shown in FIG. 1.

Now referring to FIGS. 1, 2 and 7, the front frame section 24, which has a substantially monolithic construction, has an opening 28 for receiving the panel 16 therein such that the front surface 20 of the panel 16 faces the front side 12 of the board 10. A substantially rectangular ledge 30 extends inwardly from the front frame section 24 into the opening 28 so as to engage the edges 22 of the panel 16 and to thereby retain the panel 16 between the front and rear frame sections 24, 26 (see FIG. 7). The front frame section 24 also includes a plurality of sides 32*a*-32*d* which define the opening 28 and each of which has a U-shape. More particularly, each of the sides 32*a*-32*d* is provided with an inner wall 34, an outer wall 36 and a front wall 38 which is integrally formed with the inner wall 34 and the outer wall 36 (see also FIG. 5). Each of the inner walls 34 of the sides 32*a*-32*d* is formed integrally with an adjacent pair of the inner walls 34 so as to form a substantially continuous, rectangular inner wall structure 40 (see FIGS. 1 and 2). Likewise, each of the outer walls 36 of the sides 32*a*-32*d* (with the exception of the outer walls 36 of the sides 32*a*, 32*b* as shown in FIGS. 1 and 2) is formed integrally with an adjacent pair of the outer walls 36 so as to form a substantially continuous, rectangular outer wall structure 42, which is substantially coaxial with the inner wall structure 40. Similarly, each of the front walls 38 of the sides 32*a*-32*d* (with the exception of the front walls 38 of the sides 32*a*, 32*b* as shown in FIGS. 1 and 2) is formed integrally with an adjacent pair of the front walls 38 so as to form a substantially continuous, annular front wall structure 44.

Figure 4:
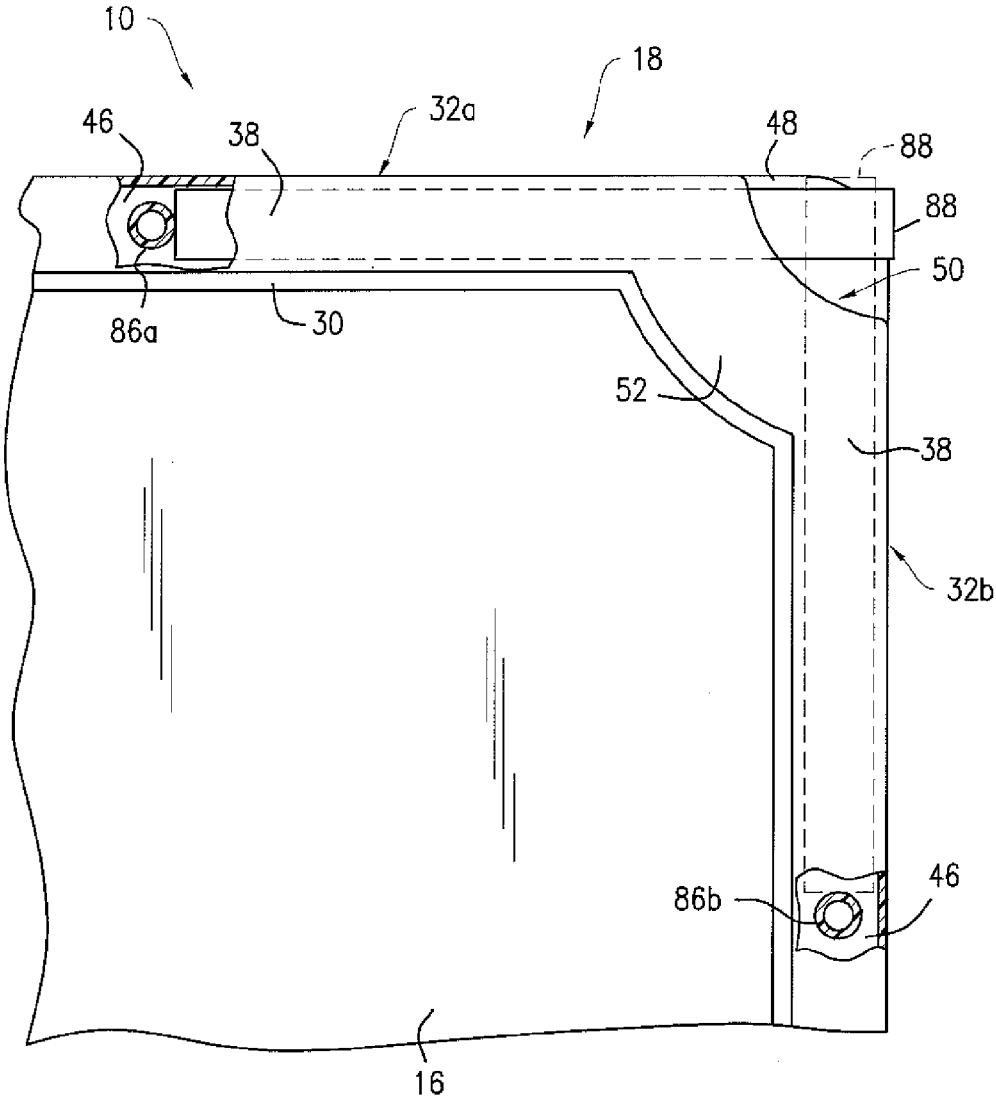
FIG. 4 is an enlarged view of a section of the board shown in FIG. 1, illustrating a pair of storage pockets, each of which is constructed so as to receive a writing instrument in a different orientation.
Figure 4A:
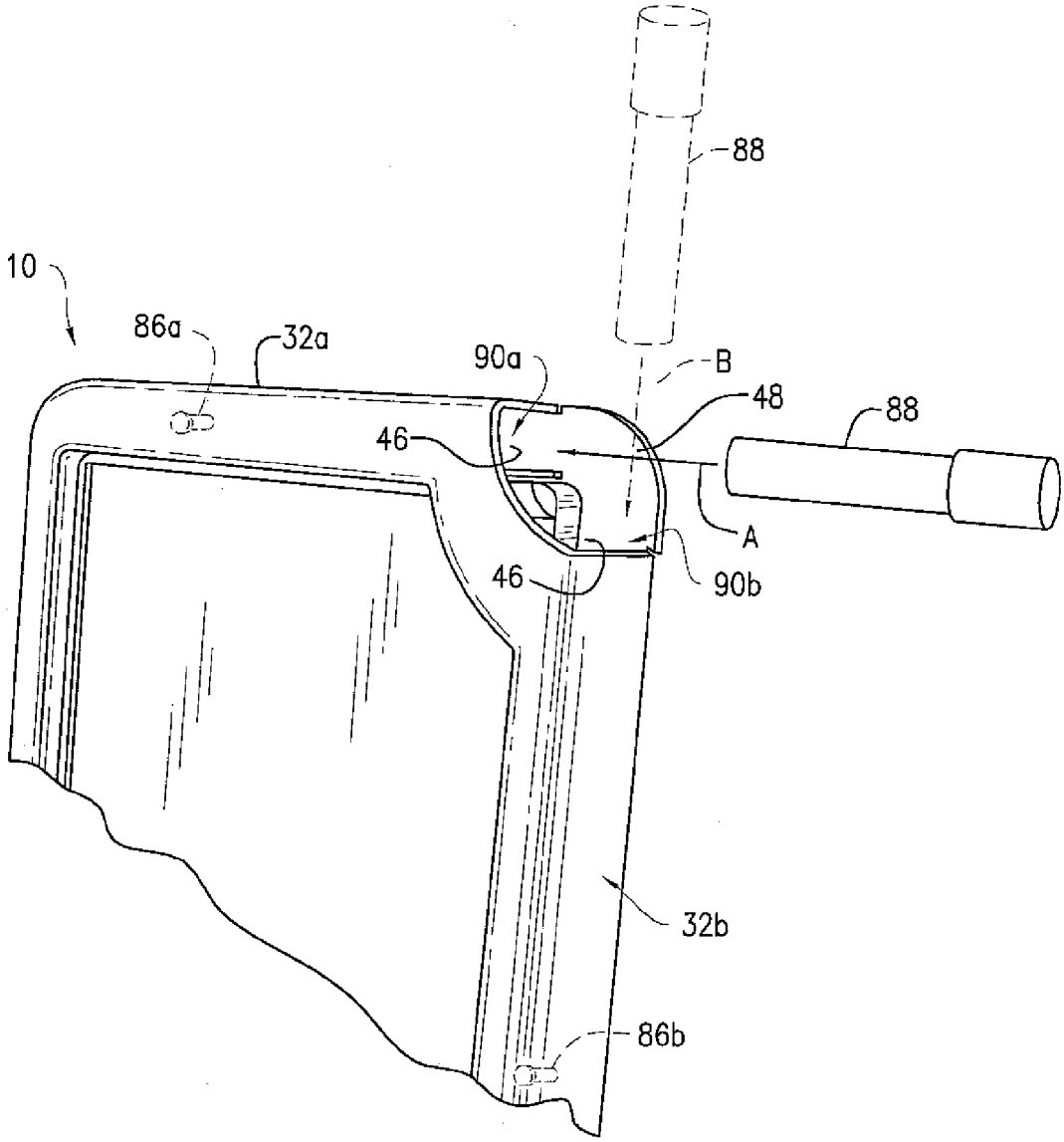
FIG. 4A is a perspective view of the section of the board shown in FIG. 4.
Figure 5:
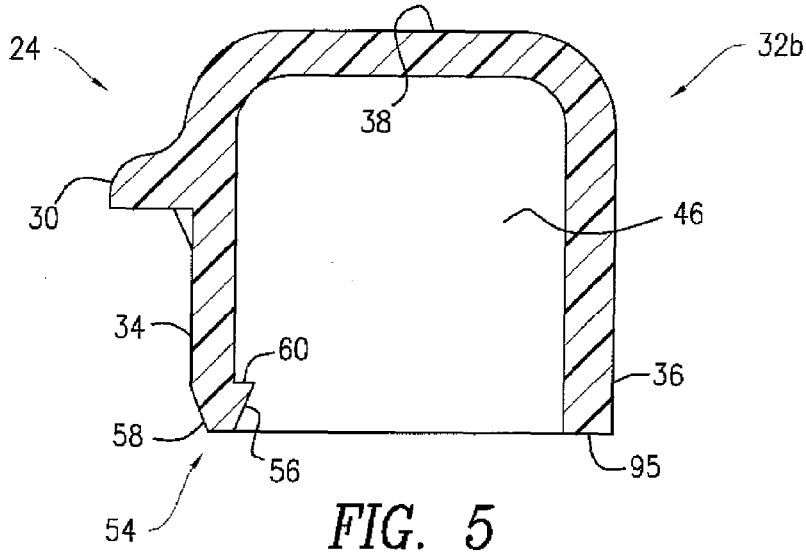
FIG. 5 is a cross-sectional view, taken along section line 5-5 and looking in the direction of the arrows, of a first frame section of the board shown in FIG. 2.

With reference to FIGS. 2 and 5, due to its U-shaped construction, each of the sides 32*a*-32*d* of the front frame section 24 is provided with a groove 46 (i.e., a channel) defined by a corresponding set of the outer walls 36, the inner walls 34 and the front walls 38. Each of the grooves 46 extends substantially along the entire length of a corresponding one of the sides 32*a*-32*d*. A cutout 48 (see FIGS. 1, 2 and 4) is formed in a corner 50 of the front frame section 24 defined by the side 32*a* and the side 32*b* (i.e., in the outer wall structure 42 and the front wall structure 44) such that each of the grooves 46 is accessible through the cutout 48 in a different direction (i.e., (1) in a direction substantially parallel to the side 32*a* for accessing the groove 46 of the side 32*a* as indicated by arrow A in FIG. 4A or (2) in a direction substantially parallel to the side 32*b* for accessing the groove 46 of the side 32*b* as indicated by arrow B in FIG. 4A). In this manner, each of the grooves 46 of the sides 32*a*, 32*b* is adapted to receive a writing instrument (e.g., a dry-erase marker, pen and pencil) through the cutout 48 (see FIGS. 4 and 4A) as will be discussed in greater detail hereinafter. An arcuate front wall 52 (see FIGS. 1 and 2) is provided at the corner 50 and is connected integrally to the front walls 38 of the sides 32*a*, 32*b*. The arcuate front wall 52 can be used to place thereon a logo, a trademark or other legends.

Referring back to FIGS. 2, 5 and 7, coupling members or tabs 54 are provided on each of the inner walls 34 of the front frame section 24. Each of the tabs 54 has a wedge shape and includes a pair of slanted sides 56, 58 and a locking surface 60 for purposes to be discussed hereinafter.

Figure 6:
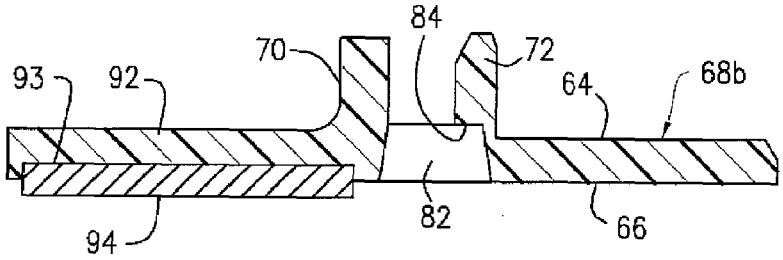
FIG. 6 is cross-sectional view, taken along section line 6-6 and looking in the direction of the arrows, of a second frame section of the board shown in FIG. 2.

With reference to FIGS. 2, 6 and 7, the rear frame section 26 is attached to the front frame section 24 for retaining the panel 16 in the frame 18. Like the front frame section 24, the rear frame section 26 has an annular, substantially rectangular shape and has an opening 62 therein. In addition, the rear frame section 26 includes a front side 64 and a rear side 66 and has a monolithic construction. The rear frame section 26 is also provided with a plurality of substantially planar walls 68*a*-68*d*, each of which is formed integrally with an adjacent pair of same so as to form a continuous annular wall structure. Each of the walls 68*a*-68*d* is received in an upper end of a corresponding one of the grooves 46 of the front frame section 24 (see FIG. 7). Each of the walls 68*a*-68*d* also includes inner and outer ridges 70, 72, which are substantially parallel to one another. The inner ridge 70 of each of the walls 68*a*-68*d* (with the exception of the inner rides 70 of the walls 68*a*, 68*b*) is integrally formed with an adjacent pair of the inner ridges 70 so as to form a generally rectangular, substantially continuous inner ridge structure 74. Similarly, each of the outer ridges 72 (with the exception of the outer ridges 72 of the walls 68*a*, 68*b*) is integrally formed with an adjacent pair of the outer ridges 72 so as to form a generally rectangular, substantially continuous outer ridge structure 76, which is substantially coaxial with the inner ridge structure 74.

Still referring to FIGS. 2, 6 and 7, each of the walls 68*a*-68*d* of the rear frame section 26 includes a plurality of mounting holes 82, each of which is sized and shaped so as to receive a corresponding one of the tabs 54 of the front frame section 24. More particularly, each of the mounting holes 82 extends completely through the rear frame section 26 from its front side 64 to its rear side 66 and is formed substantially between a corresponding pair of the inner and outer ridges 70, 72. A locking surface 84, which is defined by a lower end of a corresponding one of the outer ridges 72, is exposed to each of the mounting holes 82. Each of the locking surfaces 84 is adapted to interlock with the locking surface 60 of a corresponding one of the tabs 54 of the front frame section 24 (see FIG. 7) for easily and quickly fastening the rear frame section 26 to the front frame section 24.

The front and/or rear frame sections 24, 26 are made from a substantially rigid material which has sufficient flexibility and resilience. In this manner, the tabs 54 and/or the mounting holes 82 can undergo slight deformation during assembly and then return to their original shapes so as to allow the tabs 54 to be inserted into the mounting holes 82 and to create substantially tight engagement between the tabs 54 and the locking surfaces 84 of the rear frame section 26. In this regard, the slanted sides 56, 58 of each of the tabs 54 facilitate its insertion into a corresponding one of the mounting holes 82.

Now referring to FIGS. 2, 4 and 4A, posts 86*a*, 86*b* project from the walls 68*a*, 68*b*, respectively, of the rear frame section 26 toward the front frame section 24. The post 86*a* extends into the groove 46 of the side 32*a* of the front frame section 24. The post 86*a* is positioned such that when a writing instrument 88 is received in the groove 46 of the side 32*a* through the cutout 48 (as indicated by arrow A in FIG. 4A), it functions as a stop for the writing instrument 88, preventing same from being inserted completely into the groove 46 of the side 32*a* (see the solid line representation of the writing instrument 88 in FIG. 4). In other words, the post 86*a* is adapted to support the writing instrument 88 such that at least a portion of the writing instrument 88 projects outwardly from the groove 46 of the side 32*a* so as to permit easy removal of the writing instrument 88 from same. In this manner, the groove 46 of the side 32*a* functions as a storage pocket 90*a* for holding the writing instrument 88 in an orientation which is substantially parallel to the side 32*a* of the front frame section 24.

Still referring to FIGS. 2, 4 and 4A, the post 86*b* extends into the groove 46 of the side 32*b* of the front frame section 24. The post 86*b* is positioned such that when the writing instrument 88 is received in the groove 46 of the side 32*b* through the cutout 48 (as indicated by arrow B in FIG. 4A), it functions as a stop for the writing instrument 88, preventing the writing instrument 88 from being inserted completely into the groove 46 (see the broken line representation of the writing instrument 88 in FIG. 4). In other words, the post 86*b* supports the writing instrument 88 such that at least a portion of the writing instrument 88 projects outwardly from the groove 46 of the side 32*b* so as to permit easy removal of the writing instrument 88 from same. In this manner, the groove 46 of the side 32*b* functions as a storage pocket 90*b* for holding the writing instrument 88 in an orientation which is substantially parallel to the side 32*b* of the front frame section 24 (i.e., substantially perpendicular to the side 32*a* of the front frame section 24).

With reference to FIGS. 2, 3, 6 and 7, a substantially flat tongue 92, which has a recess 93 therein, extends inwardly into the opening 62 from each of the walls 68*b*, 68*d* of the rear frame section 26. Each of the tongues 92 is substantially flush with a corresponding one of the walls 68*b*, 68*d* of the rear frame section 26, each of which is in turn substantially flush with a rear edge 95 (see FIGS. 5 and 7) of the corresponding outer wall 36 of the front frame section 24. As a result, the rear side 14 of the board 10 is substantially flat or planar for purposes to be discussed hereinafter.

Figure 3:
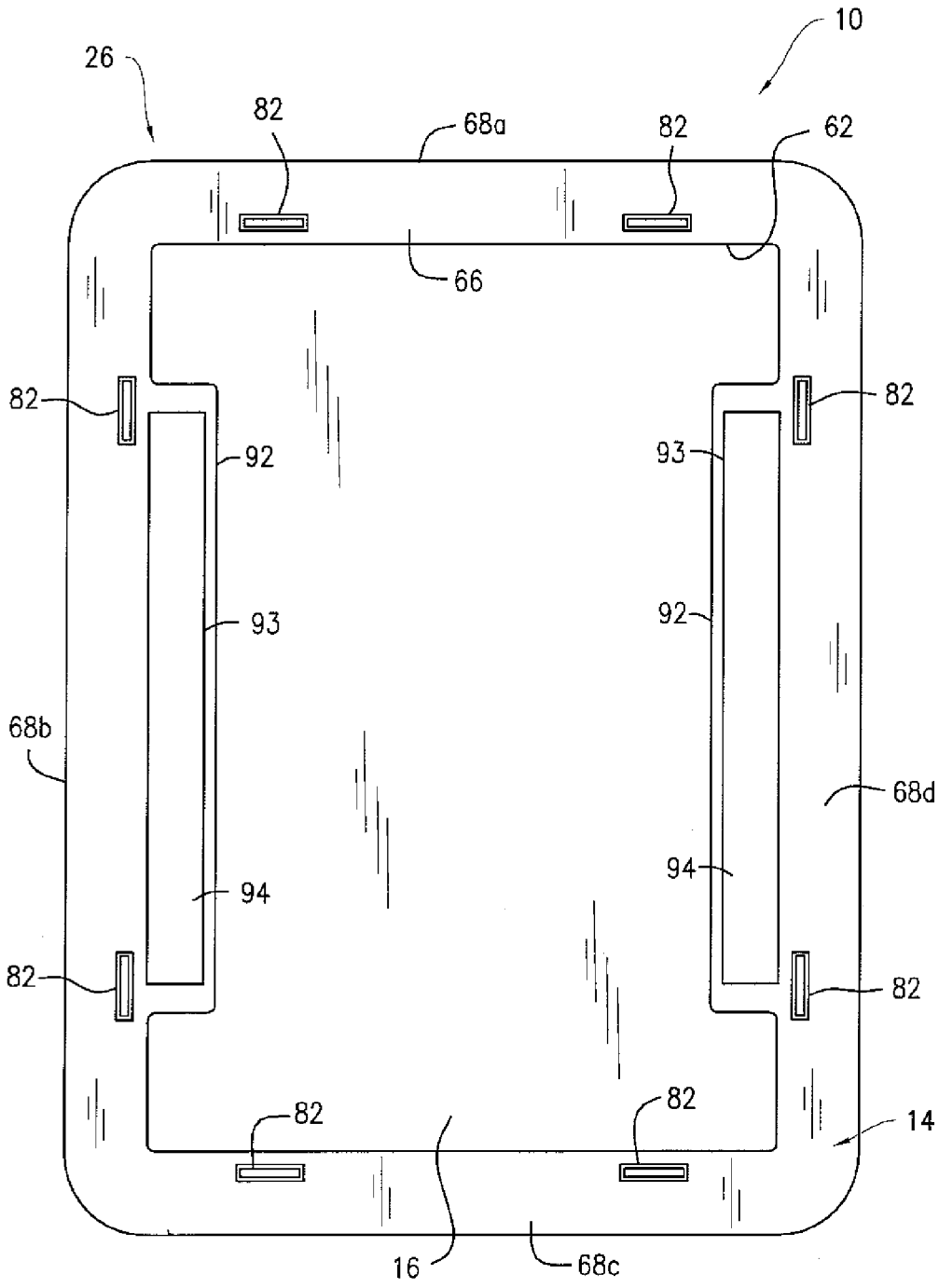
FIG. 3 is a rear elevational view of the board shown in FIG. 1.

Now referring to FIGS. 3, 6 and 7, a magnetic strip 94 is attached to each of the tongues 92. The magnetic strips 94 are used to removably attach the board 10 to a metallic supporting surface, such as a refrigerator door. Because the rear side 14 of the board 10 is substantially flat, the magnetic strips 94 can be applied thereto without providing any additional parts (e.g., spacers, etc.). More particularly, each of the magnetic strips 94 is received in a corresponding one of the recesses 93, which function to provide shear support for an adhesive material applied to the magnetic strips 94 to attach same to the corresponding tongues 92. Due to this shear support, the magnetic strips 94 is inhibited from peeling off from the corresponding tongues 92. Ribs 96 project from an inner surface of each of the tongues 92 (i.e., the surface opposite the corresponding magnetic strip 94). Each of the ribs 96 engages the panel 16 (see FIG. 7) so as to provide added rigidity to a corresponding one of the tongues 92, thereby ensuring that the tongues 92 are maintained substantially flat. In this manner, the ribs 96 function to promote optimum magnetic contact between the magnetic strips 94 and a metallic supporting surface (e.g., a refrigerator door). Alternatively, other securing mechanisms (e.g., double-sided adhesive strips, glue, etc.) can be applied to the tongues 92 to permanently or removably attach the board 10 to a suitable surface (e.g., a wall).

The front and rear frame sections 24, 26 can be made from any suitable conventional materials. For instance, the font and rear frame sections 24, 26 can be made from plastic (e.g., polypropylene) by using a conventional molding process. Moreover, the front and/or rear frame sections 24, 26 can be made to be transparent, translucent or opaque.

In order to assembly the board 10, the front frame section 24 can be laid on a substantially planar supporting surface (e.g., a table) with its front wall structure 44 facing down. The panel 16 is then placed in the opening 28 of the front frame section 24. The ledge 30 of the front frame section 24 retains the panel 16 in the opening 28. Next, the rear frame section 26 is laid on the front frame section 24. Once the rear frame section 26 is aligned properly with the front frame section 24, the walls 68*a*-68*d* of the rear frame section 26 are sequentially depressed downwardly such that the tabs 54 of the front frame section 24 are inserted into the mounting holes 82 of the rear frame section 26. As a result, the locking surfaces 84 of the rear frame section 26 engage the locking surfaces 60 of the tabs 54 of the front frame section 24 in an interlocking manner (see FIG. 7). In other words, the tabs 54 are snap-fitted into the mounting holes 82. The front and rear frame sections 24, 26 are hence secured to each other, thereby capturing the panel 16 therebetween. In this manner, the panel 16 can be easily and quickly assembled with the frame 18. When assembled, the front and rear frame sections 24, 26 are adapted to substantially constantly grip the panel 16 therebetween even when the board 10 is twisted.

It should be appreciated that the present invention provides numerous advantages over the prior art discussed above. For instance, because of the tabs 54 provided in the front frame section 24 and the mating mounting holes 82 provided in the rear frame section 26, the board 10 can be assembled easily and quickly without using additional components, such as glue, screws, nails, etc. In addition, because the tabs 54 and the mounting holes 82 are located within the frame 18 and are therefore hidden away from view, the board 10 is provided with an attractive or refined appearance (no glue, screws, nails, etc. which are utilized in the prior art are seen on the board 10). Moreover, the storage pockets 90*a*, 90*b*, which are oriented substantially at a 90° angle with respect to each other, allow the writing instrument 88 to be stored in the frame 18 in one of at least two different orientations without the use of extra parts (e.g., a holding clip). By way of example, when the writing instrument 88 is inserted in the storage pocket 90*a*, it is oriented in a direction substantially parallel to (i.e., oriented colinearly with) the side 32*a* of the front frame section 24 (e.g., horizontally). Conversely, when the writing instrument 88 is inserted into the storage pocket 90*b*, it is orientated in a direction substantially parallel (i.e., is oriented colinearly with) to the side 32*b* of the front frame section 24 (e.g., vertically). As a result, the board 10 can be positioned in a plurality of positions (e.g., it can be positioned in a vertical orientation with the side 32*a* being positioned substantially horizontally as shown in FIG. 1 or positioned in a horizontal orientation with the side 32*a* being positioned substantially vertically).

It should be noted that the present invention can have numerous modifications and variations. For instance, other types of quick-fastening mechanisms can be utilized for attaching the front frame section 24 to the rear frame section 26. Such fastening mechanisms can attach the front frame section 24 to the rear frame section 26 either removably or permanently. When attached removably, the front frame section 24 can be disengaged from the rear frame section 26 for removing and replacing the panel 16 with a replacement panel. Moreover, additional storage pockets can be provided at different locations on the frame 18 (e.g., storage pockets can be formed in the side 32*c*, 32*d* of the frame 18). Alternatively, one of the storage pockets 90*a*, 90*b* can be eliminated, thereby providing the board 10 with only one storage pocket. In addition, one or each of the storage pockets 90*a*, 90*b* can be formed at a different location in or on the frame 18. For example, the storage pocket 90*b* can be relocated to the side 32*d* of the frame 18.

The present invention can also be used in conjunction with any type of writing board, such as white boards, dry-erase boards, marker boards, etc. In addition, the frame 18 of the board 10 can be used to mount and/or hold many different types of rigid or flexible panels or boards (e.g., photographs, pictures, push-pin panels or boards, etc.)

between the front and rear frame sections 24, 26. In other words, the dry-erase panel 16 can be replaced with any one of these panels or boards. In such circumstances, the term "panel", as used herein, shall denote to include all such types of panels.

FIGS. 8-12 depict a second embodiment of the present invention. Elements illustrated in FIGS. 8-12, which correspond, either identically or substantially, to the elements described above with respect to the embodiment of FIGS. 1-7, have been designated by corresponding reference numerals increased by one hundred. Unless otherwise stated and/or illustrated, the embodiment of FIGS. 8-12 is constructed and assembled in the same basic manner as the embodiment of FIGS. 1-7.

Figure 8:
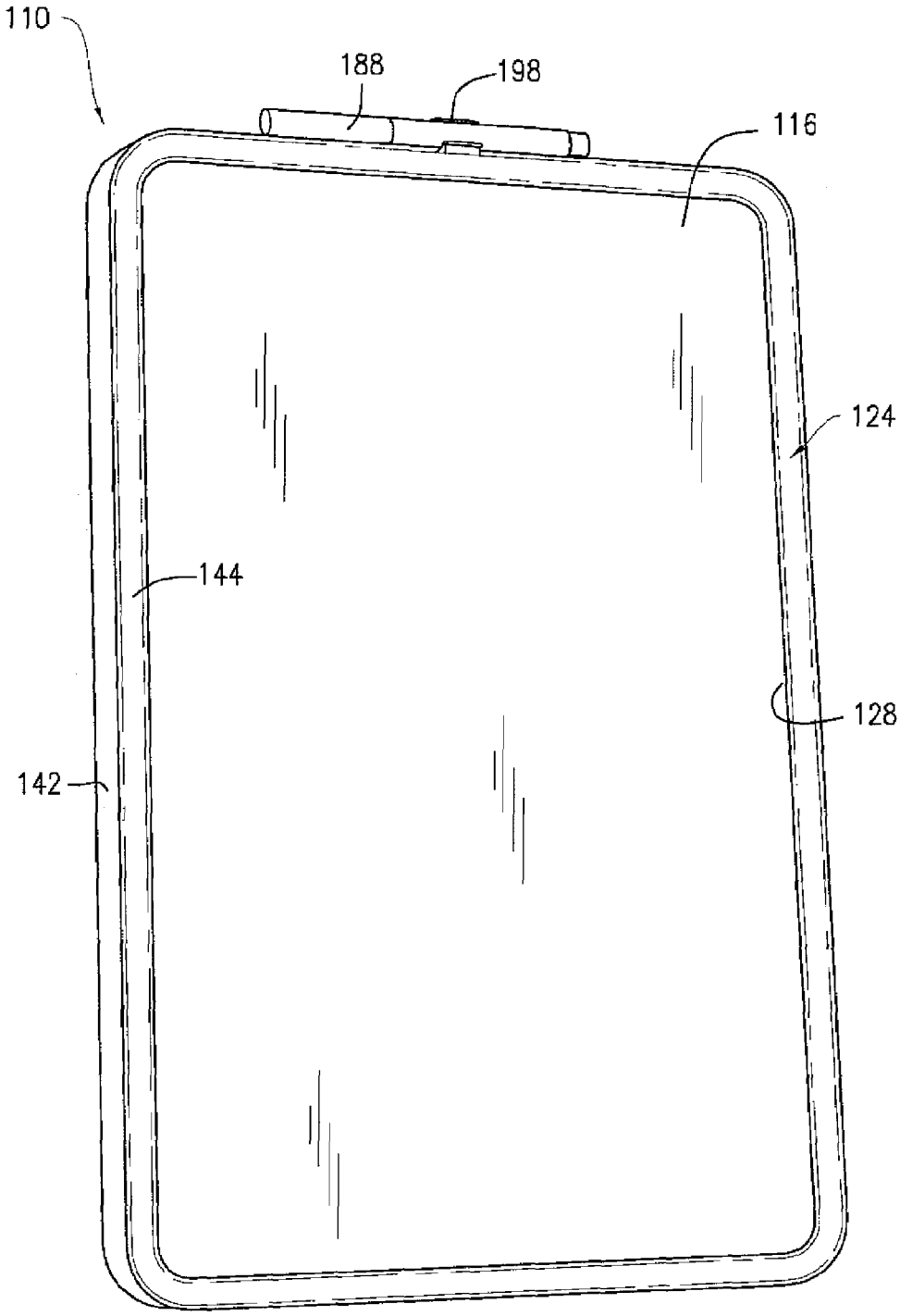
FIG. 8 is a perspective view of a dry-erase board constructed in accordance with a second embodiment of the present invention.
Figure 9:
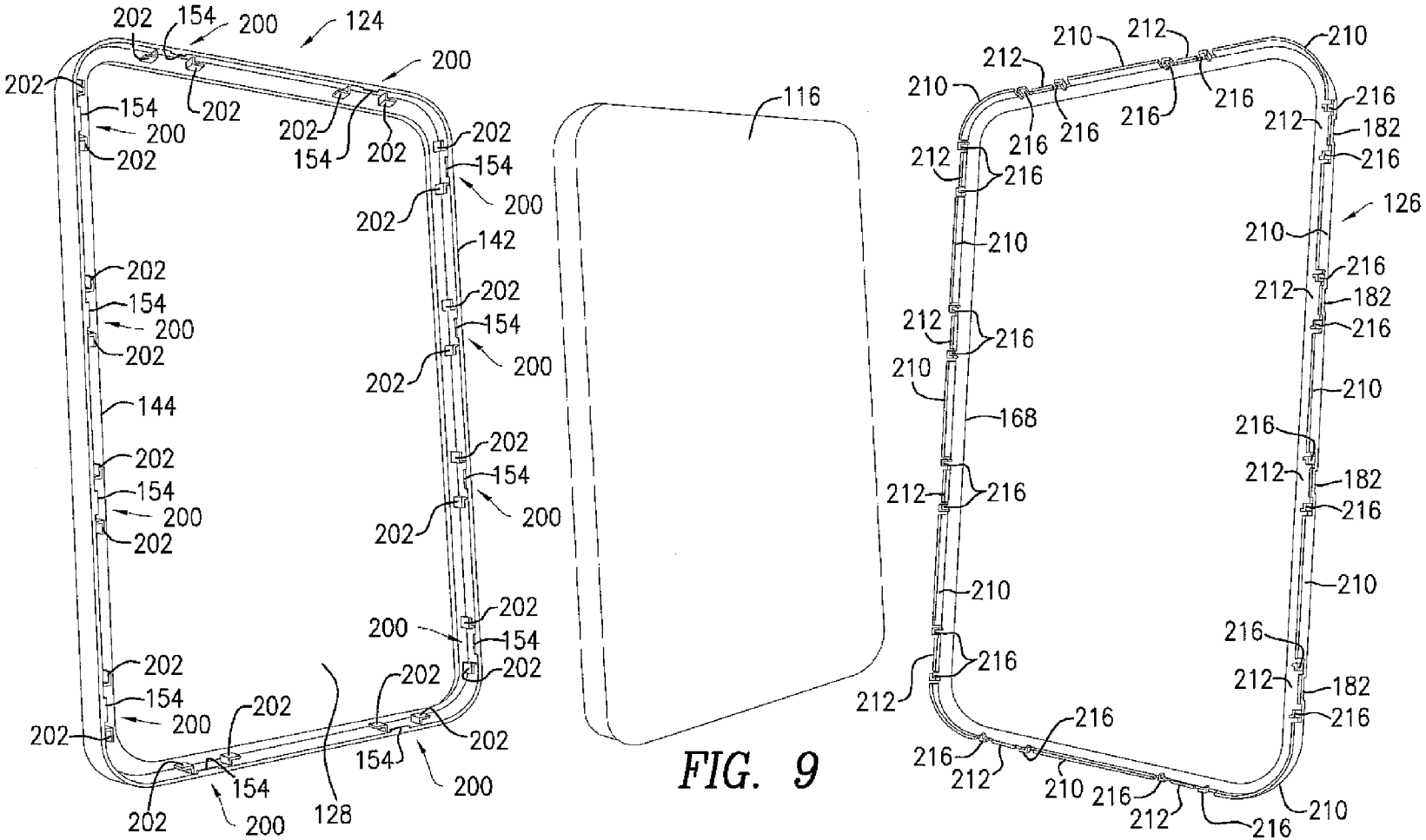
FIG. 9 is an exploded perspective view of the board shown in FIG. 8.

Referring to FIGS. 8 and 9, there is shown a dry-erase board 110 constructed in accordance with a second embodiment of the present invention. Unlike the board 10 shown in FIGS. 1-7, the board 110 is provided with a clip 198, rather than a storage pocket, for holding a writing instrument 188. The board 110 includes a panel 116 and front and rear frame sections 124, 126, which are attached to one another for retaining the panel 116 therebetween. The front frame section 124 has a substantially annular outer wall 142 and a substantially annular front wall 144 which projects from the outer wall 142. The front frame section 124 is also provided with an opening 128 defined by the outer wall 142 and the front wall 144. The outer wall 142 includes a plurality of coupling units 200 spaced apart from one anther (see FIG. 9). More particularly, each of the coupling units 200 includes a tab 154 (see also FIGS. 10 and 11) and a pair of L-shaped retaining members 202 (see also FIGS. 10 and 11) projecting inwardly from the outer wall 142. Each of the tabs 154 has a slopping edge 156 (see FIG. 12) opposite the outer wall 142 and a locking surface 160 (see FIG. 12), while each of the retaining members 202 has a base 204 (see FIG. 10) projecting substantially perpendicularly from the outer wall 142. A leg 206 (see FIG. 10) extends from the base 204 of each of the bases 204 away from a corresponding one of the tabs 154 so as to cooperate with same to form a space 208.

Figure 10:
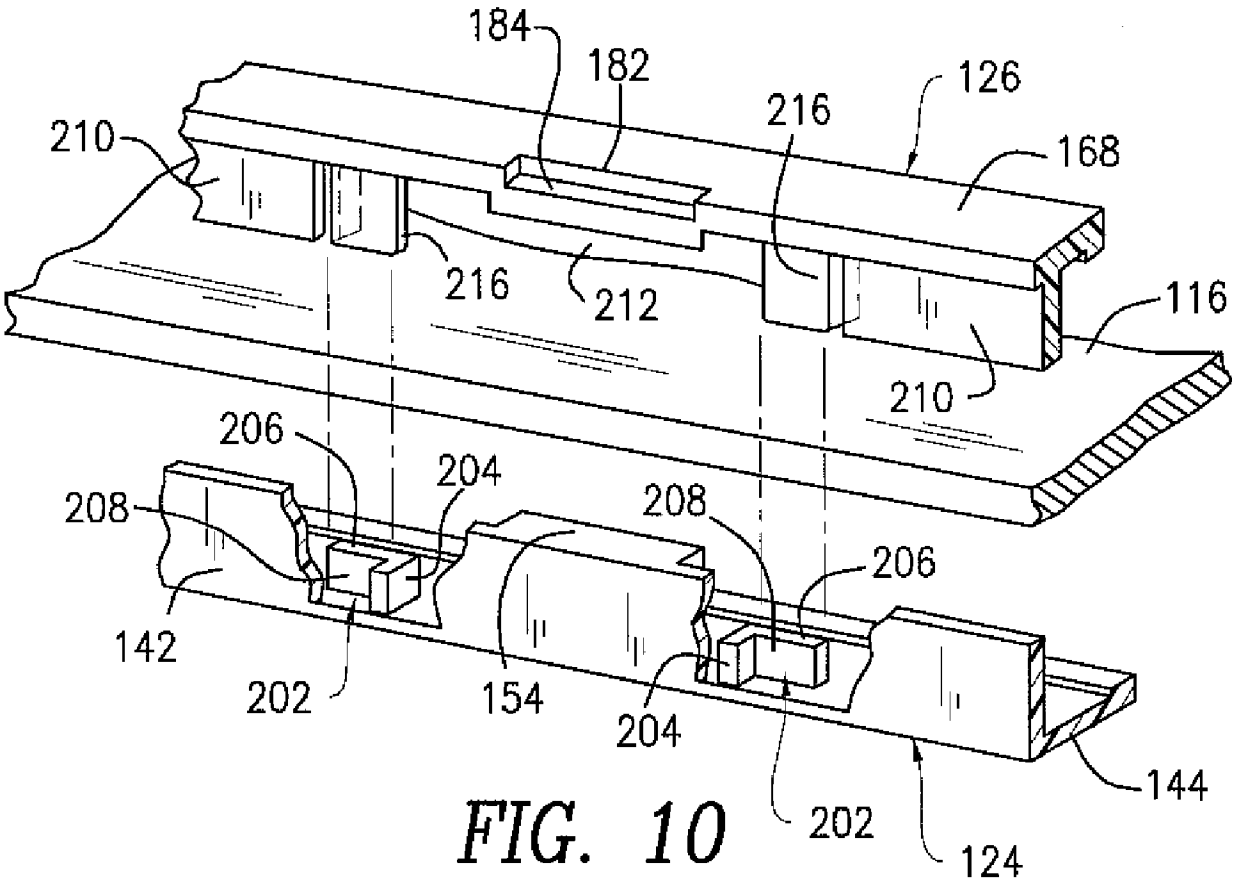
FIG. 10 is an exploded perspective view of a section of the board shown in FIG. 8.
Figure 12:
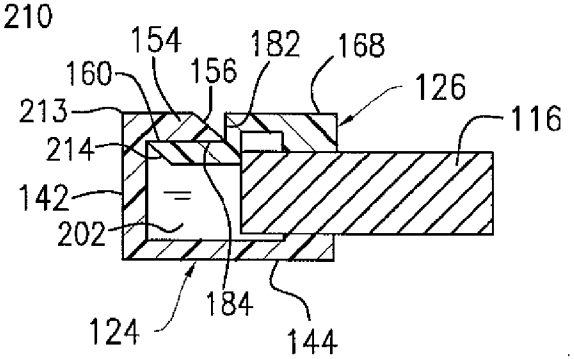
FIG. 12 is a cross-sectional view, taken along section line 12-12 and looking in the direction of the arrows, of the board shown in FIG. 11.

With reference to FIGS. 9 and 10, the rear frame section 126 has an annular base wall 168 and a plurality of fins 210 projecting from the base wall 168. A slot 212 is formed between each pair of the fins 210 for receiving a corresponding pair of the retainer members 202 of the front frame section 124 such that the fins 210 can be positioned within the opening 128 defined by the outer wall 142 of the front frame section 124 (see FIG. 11). In this manner, when the rear frame section 126 is attached to the front frame section 124, the base wall 168 is positioned substantially flush with a rear edge 213 of the outer wall 142 of the front frame section 124 (see FIG. 12).

The base wall 168 has a plurality of notches 182 (see FIGS. 9, 10 and 11) formed therein. The base wall 168 also includes a plurality of locking surfaces 184, each of which defines a lower end of a corresponding one of the notches 182. A inwardly slopping edge 214 (see FIG. 12) is formed on the base wall 168 below each of the locking surfaces 184. Each of the notches 182 is sized and shaped so as to receive a corresponding one of the tabs 154 of the front frame section 124 in a snap-fitting fashion such that each of the locking surfaces 184 of the rear frame section 126 interlocks with a corresponding one of the locking surfaces 160 of the front frame section 124 (see FIGS. 11 and 12). In this manner, the rear frame section 126 can be securely affixed to the front frame section 124 and retain the panel 116 between the front wall 144 of the front frame section 124 and the base wall 168 of the rear frame section 126 (see FIGS. 11 and 12).

The front and/or rear frame sections 124, 126 are made from a substantially rigid material (e.g., plastic) which has sufficient flexibility and resilience. In this manner, the slopping edges 156 of the front frame section 124 and/or the slopping edges 214 of the rear frame section 126 can undergo slight deformation during assembly, allowing the tabs 154 to be inserted into the notches 182 and then return to their original shapes so as to create substantially tight fit therebetween. In this regard, the slopping edges 156 and the slopping edges 214 cooperate with each other so as to facilitate the insertion of the tabs 154 into the notches 182.

Figure 11:
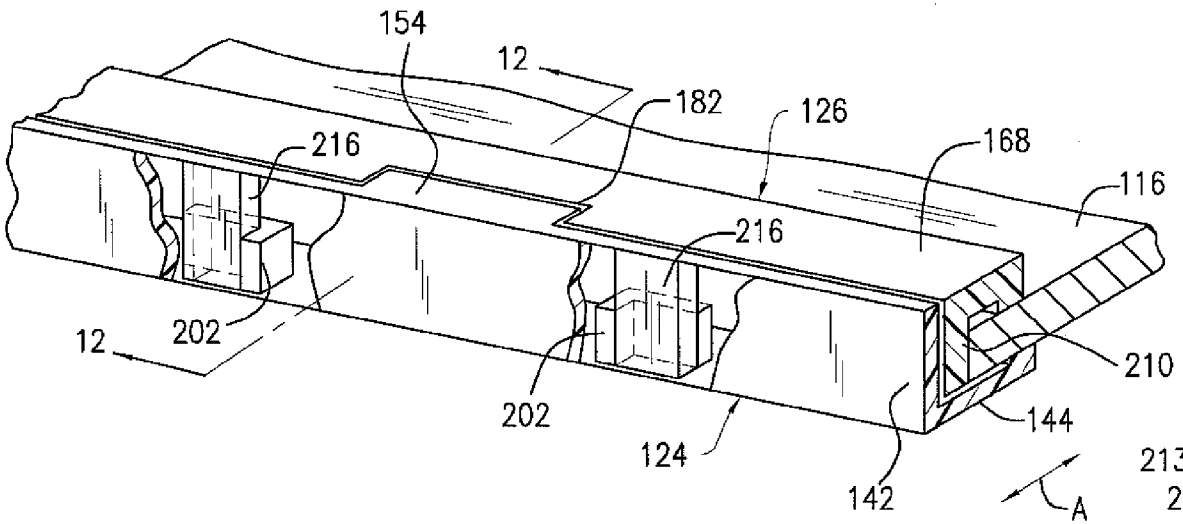
FIG. 11 is an assembled view of the section of the board shown in FIG. 10.

Referring to FIGS. 9, 10 and 11, multiple pairs of L-shaped retainer members 216 extend from the base wall 168, each pair interposing a corresponding one of the notches 182. Each of the retainer members 216 is adapted to be received and retained in a corresponding one of the spaces 208 formed by the L-shaped retainer members 202 of the front frame section 124 (see FIG. 11). In this manner, the retainer members 216 of the rear frame section 126 cooperate with the retainer members 202 of the front frame section 124 so as to prevent the rear frame section 126 from moving in a laterally (i.e., radially) direction (as indicated by arrow A in FIG. 11) relative to the front frame section 124, thereby inhibiting inadvertent disengagement of the tabs 154 from the notches 182.

It should be appreciated that the board 110 provides numerous benefits and advantages over the prior art discussed above. For instance, the front and rear frame sections 124, 126 can be snap-fitted to one another easily, thereby facilitating quick construction of the board 110. Moreover, because of the tight fit between the tabs 154 and the notches 182, the front and rear sections 124, 126 are securely attached to one another. Further, due to their flexibility and resiliency, the front and rear frame sections 124, 126 allow small adjustments in the thickness of the panel 16 captured therebetween, thereby inhibiting vibration or rattling of the board 110. The frame 118 of the board 110 can also be used to mount many different types of panels or boards (e.g., photographs, pictures, push-pin panels or boards, other writing panels or boards, etc.) between the front and rear frame sections 124, 126.

It will be understood that the embodiments described herein are merely exemplary and that a person skilled in the art may make many variations and modifications without departing from the spirit and scope of the invention. For instance, the present invention can be provided with any type of fastening mechanisms which permit quick and easy attachment of the front frame section to the rear frame section. All such variations and modifications, including those discussed hereinabove, are intended to be included within the scope of the invention as defined in the appended claims.

What is claimed is:

1. A panel assembly comprising a panel; and a frame having a generally annular shape and including first and second sections, said first section including an inwardly-extending ledge and said second section including first and second ridges extending upwardly from said second section, said panel being retained between said inwardly-extending ledge of said first section and said first ridge of said second section, said frame including a first snap-fit member positioned on said first section and a second snap-fit member positioned on said second section, the first and second snap-fit members cooperating to attach said second section to said first section, thereby facilitating the assembly of said panel with said frame.

2. The assembly of claim 1, wherein said first section has an opening therein; and said panel has a surface, said surface being exposed through said opening.

3. The assembly of claim 2, wherein said surface includes a writing surface.

4. The assembly of claim 1, wherein said first snap-fit member includes a plurality of tabs formed on said first section of said frame, each of said tabs including a first locking surface; and wherein said second snap-fit member includes a plurality of mounting holes, which are formed in said second section of said frame, and a plurality of second locking surfaces, which are provided on said second section of said frame, each of said tabs being received in a corresponding one of said mounting holes such that each of said first locking surfaces of said tabs interlocks with a corresponding one of said second locking surfaces of said second snap-fit member.

5. The assembly of claim 4, wherein said first section of said frame includes a first wall having a generally annular shape, said tabs being located on said first wall of said first section; and wherein said second section of said frame includes a second wall having a generally annular shape, said mounting holes being formed in said second wall of said second section, said second locking surfaces of said at least one second member being defined by said second wall of said second section.

6. The assembly of claim 5, wherein said first and second ridges define a groove therebetween, each of said mounting holes being formed in said second wall substantially between said ridges.

7. The assembly of claim 1, wherein said frame includes an exterior wall and a storage pocket, said storage pocket being covered at least partially by said exterior wall so as to receive and hold a writing instrument therein.

8. The assembly of claim 1, wherein said frame includes an exterior wall, a first storage pocket, which is formed in said body for receiving a writing instrument in a first orientation, and a second storage pocket, which is formed in said body for receiving a writing instrument in a second orientation which is different from said first orientation.

9. A panel assembly comprising a panel; a frame having a generally annular shape and including first and second sections, said panel being retained between said first and second sections, wherein said first section includes a plurality of tabs, each of said tabs including a first locking surface, wherein said second section includes a plurality of notches, each of said tabs being received in a corresponding one of said notches so as to attach said first and second sections of said frame to each other, wherein said first section of said frame includes a first wall having a generally annular shape, said tabs being located on said first wall of said first section, and wherein said second section of said frame includes a second wall having a generally annular shape, said notches being formed in said second wall of said second section along a perimeter thereof, said panel being captured between said first and second walls: and retaining means for retaining each of said tabs in a corresponding one of said notches.

10. The assembly of claim 9, wherein said retaining means includes first retaining members, which project from said first wall of said first section of said frame, and second retaining members, which project from said second wall of said second section of said frame.

11. The assembly of claim 10, wherein each of said tabs is interposed by a corresponding pair of said first retaining members; and wherein each of said notches being interposed by a corresponding pair of said second retaining members, each of said first retaining members engaging a corresponding one of said second retaining members so as to inhibit lateral movement of said second wall relative to said first wall.

* * * * *

UNITED STATES PATENT AND TRADEMARK OFFICE

CERTIFICATE OF CORRECTION

PATENT NO. : 7,293,993 B2
APPLICATION NO. : 10/749953
DATED : November 13, 2007
INVENTOR(S) : Gennadi I. Fedorov et al.

It is certified that error appears in the above-identified patent and that said Letters Patent is hereby corrected as shown below:

In Column 5, line 55, “font” should be deleted and --front-- should be inserted.

In Column 7, line 29, “anther” should be deleted and --another-- should be inserted;

line 34, “slopping” should be deleted and --sloping-- should be inserted;

line 58, “A” should be deleted and --An-- should be inserted;

line 58, “slopping” should be deleted and --sloping-- should be inserted.

In Column 8, lines 6-7, “slopping” should be deleted and --sloping-- should be inserted;

line 8, “slopping” should be deleted and --sloping-- should be inserted;

line 12, “slopping” should be deleted and --sloping-- should be inserted;

line 13, “slopping” should be deleted and --sloping-- should be inserted.

Signed and Sealed this

Fourth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,293,993 B2
APPLICATION NO. : 10/749953
DATED : November 13, 2007
INVENTOR(S) : Gennadi I. Fedorov et al.

It is certified that error appears in the above-identified patent and that said Letters Patent is hereby corrected as shown below:

On the title page, item [73] the Assignee "Rose Art Industries, Inc." should be deleted, and --Mega Brands International, Luxembourg, Zug Branch-- should be inserted.

Signed and Sealed this
Twenty-eighth Day of December, 2010

David J. Kappos

David J. Kappos
*Director of the United States Patent and Trademark Office*